United States Patent [19]

Daviduk et al.

[11] 4,018,280

[45] Apr. 19, 1977

[54] PROCESS FOR IN SITU RETORTING OF OIL SHALE

[75] Inventors: Nicholas Daviduk, Pennington; David W. Lewis, Lawrenceville, both of N.J.; Michael T. Siuta, Torrance, Calif.

[73] Assignee: Mobil Oil Corporation, New York City, N.Y.

[22] Filed: Dec. 10, 1975

[21] Appl. No.: 639,541

[52] U.S. Cl. ..... 166/266; 166/267; 166/272; 299/2

[51] Int. Cl.[2] ..... E21B 43/24

[58] Field of Search ..... 166/259, 261, 266, 267, 166/272, 302, 303; 299/2; 208/11 R

[56] References Cited

UNITED STATES PATENTS

| | | | |
|---|---|---|---|
| 1,269,747 | 6/1918 | Rogers | 299/2 |
| 1,919,636 | 7/1933 | Karrick | 299/2 |
| 2,584,606 | 2/1952 | Merriam et al. | 166/272 |
| 2,642,943 | 6/1953 | Smith et al. | 166/251 X |
| 3,036,632 | 5/1962 | Koch et al. | 166/256 |
| 3,294,167 | 12/1966 | Vogel | 166/272 |
| 3,454,958 | 7/1969 | Parker | 166/272 X |
| 3,484,364 | 12/1969 | Hemminger | 208/11 R |
| 3,548,938 | 12/1970 | Parker | 166/266 X |
| 3,597,347 | 8/1971 | Ellington, Jr. | 208/11 R |
| 3,661,423 | 5/1972 | Garret | 299/2 |

*Primary Examiner*—Stephen J. Novosad
*Assistant Examiner*—George A. Suchfield
*Attorney, Agent, or Firm*—C. A. Huggett; Drude Faulconer

[57] ABSTRACT

A process for in situ retorting of oil shale wherein an externally heated gas is circulated through a first retort zone. Surface retorting units comprised of compressors and furnaces are used to start the retorting process and to continue same until the off gas being recovered from the first retort zone reaches a temperature condition which is indicative that adequate heat is available in the retort zone to complete the retorting process without further external heating of the retorting gas. The surface retorting units are then replaced with frontal advance units comprised of low head fans which are capable of circulating the required volume of retorting gas but which require substantially less power to operate than the compressors. Also, when the units are interchanged the off gas from the first retort zone is diverted through a second retort zone to cool the off gas and to preheat the second zone.

7 Claims, 3 Drawing Figures

PROCESS FOR IN SITU RETORTING OF OIL SHALE

BACKGROUND OF THE INVENTION

The present invention relates to a hydrocarbon recovery method and more particularly relates to a method of in situ retorting an oil shale deposit to recover hydrocarbons therefrom wherein a heated gas stream is circulated through a rubblized oil shale zone within said deposit.

Oil shale deposits are shale formations wherein useful hydrocarbons exist in the form of "kerogen". While kerogen, which is a solid or semisolid, is for all practical purposes immobile within the shale, it is well known that liquid and gaseous hydrocarbons can be recovered by heating the oil shale. In recovering hydrocarbons from oil shale by use of heat, two basic techniques have evolved: surface retorting and in situ retorting.

Due to the problems normally encountered in surface retorting (e.g., cooling and disposal of spent shale), in situ retorting of oil shale is becoming more attractive as a possible means to recover hydrocarbons from oil shale. In certain in situ retorting operations, a retorting zone or gallery is formed within the oil shale deposit by first mining out a portion of the shale to create a cavity and then rubblizing the surrounding shale into the cavity by means of explosives or the like. The necessary heat for retorting is then applied to the rubblized shale either by in situ combustion or by circulating externally heated gas therethrough.

In processes where an externally heated retorting gas is used, it is common to use a portion of the recovered gaseous products, i.e., "off gas", as the retorting gas. As off gas is recovered from the retort zone, a portion of it is passed through surface retorting units where it is compressed and heated, and then reinjected into the retort zone. Surface retorting units of this type are comprised of gas compressors and gas furnaces. However, due to large pressure drops across the furnaces used to heat the gas to the high temperatures required, large quantities of power must be expanded to drive expensive compressors to overcome these pressure drops and those other pressure losses which occur throughout the circulation path of the retorting gas. Since presently all factors relating to economic success of shale oil recovery are critical, any savings in these large power requirements may affect the profits of an operation to the extent that the operational life of a particular retorting process is extended which would otherwise have to be abandoned before all recoverable hydrocarbons have been produced.

SUMMARY OF THE INVENTION

The present invention provides an in situ retorting process for recovering hydrocarbon from a retort zone formed in an oil shale deposit wherein the power required for circulating retorting gas is substantially reduced during the latter stages of the process.

A retort zone of rubblized shale is formed within an oil shale deposit and the retorting process is commenced. Off gas from the retort zone is passed through a surface retorting unit comprised of compressor means and heating means, e.g., gas fired furnaces. The gas is compressed, heated, and then circulated through the retort zone to heat the shale therein to thereby recover hydrocarbons as will be explained more fully below.

As the gas is circulated through the furnaces, piping, and retort zone, large pressure drops occur which have to be overcome by the compressors. To boost the pressure of the gas stream sufficiently to overcome these losses, expensive compressors requiring large amounts of power to operate are required. Of the total pressure drop encountered during circulation of the retorting gas, the largest drop occurs across the furnaces needed to heat the gas to the high temperatures required. The present invention provides a process where such compressors are used to circulate retorting gas only until that time when there is sufficient heat within a retort zone to carry out the remainder of the retorting operation without adding additional external heat. When this condition exists, as determined from the temperature of the off gas from the retort zone, the surface retorting units comprised of the compressor and furnaces are replaced with frontal advance units which are comprised only of low head fans. These fans do not have to overcome the large pressure drops that the compressors did since the main cause of the pressure loss, i.e., furnaces, are no longer in the circulation path. Accordingly, substantially less power is required to operate the less expensive fans. Also, the more expensive compressors are now free to commence initial retorting steps in another retort zone.

As the unheated gas is circulated through the retort zone by the fans, it picks up heat from the spent portion of the zone being retorted and continues to advance the retorting front through the zone until the process is completed as will become apparent from the detailed description below.

Also in the present invention, when the frontal advance units replace the surface retorting units, the off gas from the retort zone is diverted through a second retort zone where it gives up heat. This aids in cooling the gas which makes it easier to handle at the surface, preheats the second retort zone, and allows hydrocarbons to condense out of the gas into the second zone from which they can be recovered when said second zone is retorted.

BRIEF DESCRIPTION OF THE DRAWINGS

The actual operation and the apparent advantages of the invention will be better understood by referring to the drawings in which like numerals identify like parts and in which.

DESCRIPTION OF THE PREFERRED EMBODIMENT

Figure 1:
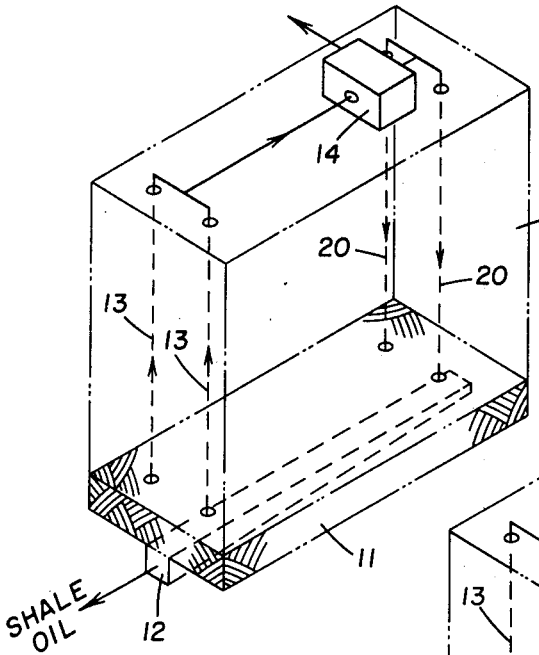
FIG. 1 is a perspective view of a retort zone within an oil shale deposit undergoing an in situ retorting process in accordance with the present invention.
Figure 2:
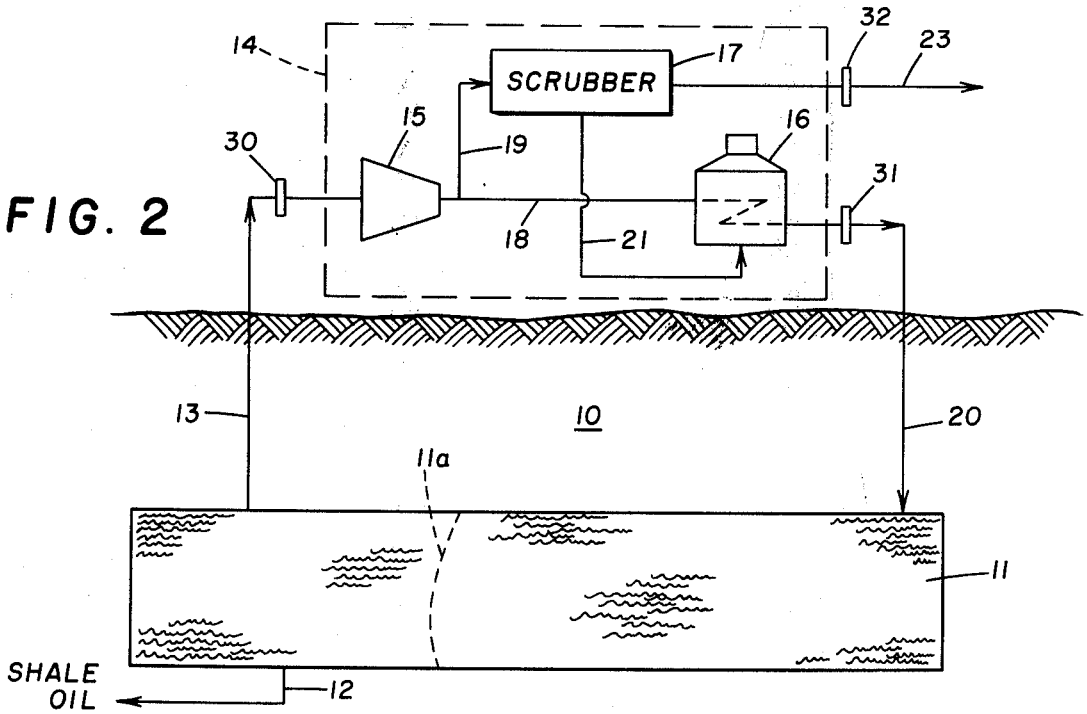
FIG. 2 is a schematic view of said process shown in FIG. 1.

Referring more particularly to the drawings, FIGS. 1 and 2 disclose an oil shale deposit 10 in which a gallery or retort zone 11 has bee formed. Retort zone 11 may be formed by any known technique, e.g., a portion of the oil shale can be mined out to establish a cavity into which surrounding shale is then rubblized by means of explosives or the like. For a more complete description of such techniques, see U.S. Pat. Nos. 3,011,776; 2,481,051; and 1,919,636.

In the present invention, a retorting gas is heated and circulated through retort zone 11 to recover hydrocarbons from the rubblized shale within zone 11. This retorting gas is comprised of the gaseous products recovered from the retorting operation, itself. Gas may be temporarily supplied from an external source for start-up operations. The retorting gas gives up heat to the shale as it is circulated therethrough and the gaseous hydrocarbons formed from the kerogen in zone 11 flow along with the retorting gas back to the surface. The liquid hydrocarbons formed from the kerogen flow downward by gravity through the rubblized shale into sump 12 or the like from which they can be recovered through a well (not shown) or the like.

Looking now at FIG. 2, as the retorting operation is commenced, the off gas exits from zone 11, flows to the surface through outlets 13, and passes into surface retorting unit 14. Although only one retorting unit is shown in detail, it should be recognized that the actual size and number of such units will be dictated by the particular retort operation involved. Retorting units 14 are basically comprised of compressor means 15, heating means 16, a gas treating means (e.g., scrubber 17), and the associated piping.

Compressor means 15, which is preferably comprised of one or more commercially available centrifugal compressors, boosts the pressure of the off gas stream to a value necessary to overcome the pressure drop which occurs in the piping, heating means 16, and the rubblized shale in retort zone 11, thereby providing the pressure required to insure continued circulation of gas through the retort system.

The off gas stream is split after it passes through compressor means 15 into a first portion which flows through line 18 to heating means 16 and a second portion which flows through line 19 to gas treating means 17. The gas flowing through line 18 comprises the retorting gas which is recycled back to retort zone 11 through inlets 20 after it is heated by heating means 16. Heating means 16 is preferably one or more gas-fired furnaces which heat the retorting gas to a temperature, e.g., 1175° F., capable of retorting the shale in zone 11. The gas flowing through line 19 is treated by means 17 to remove unwanted diluents, e.g., an amine scrubber may be used to remove the ammonia, hydrogen sulfide, and a large percentage of the carbon dioxide. A part of this treated gas is supplied through line 21 to heating means 16 to serve as fuel therefor. The excess gas from treating means 17 flows through line 23 and may be used to generate electrical power, sold as industrial gas, or put to any other suitable use.

Surface retort units 14 are used to start the retorting operation and are used to heat and circulate the retorting gas until sufficient heat is available in retort zone 11 to complete the retorting operation without any further external heating. This condition occurs from the externally heated gas giving up heat to the shale as the gas moves through zone 11. The shale holds a substantial portion of this heat and as more and more heated gas is circulated, the retorting front 11*a* moves away from inlets 20 toward outlets 13. The spent portion of the shale behind front 11*a* increases in temperature and accepts less and less heat from the externally heated gas as the gas passes therethrough. Accordingly, the temperature of the off gas from outlets 13 begins to rise as front 11*a* moves further into zone 11. Based on a heat and material balance which includes such factors as the size of zone 11, oil content of shale, inlet temperature and rate of retorting gas, etc., the time of switch over to frontal advance units is calculated to determine when there will be sufficient heat available in the spent portion of the shale behind retort zone to complete the retorting zone 11 without further external heating of the retorting zone. Compressors 15 must be designed so that this temperature is below the maximum allowable suction inlet temperature of the compressors. At this point, there is no need to continue to externally heat the retorting gas since unheated gas flowing through zone 11 from inlets 20 to outlets 13 will pick up heat from the spent shale behind front 11*a* and will be hot enough when it reaches front 11*a* to advance same through the remainder of zone 11.

Figure 3:
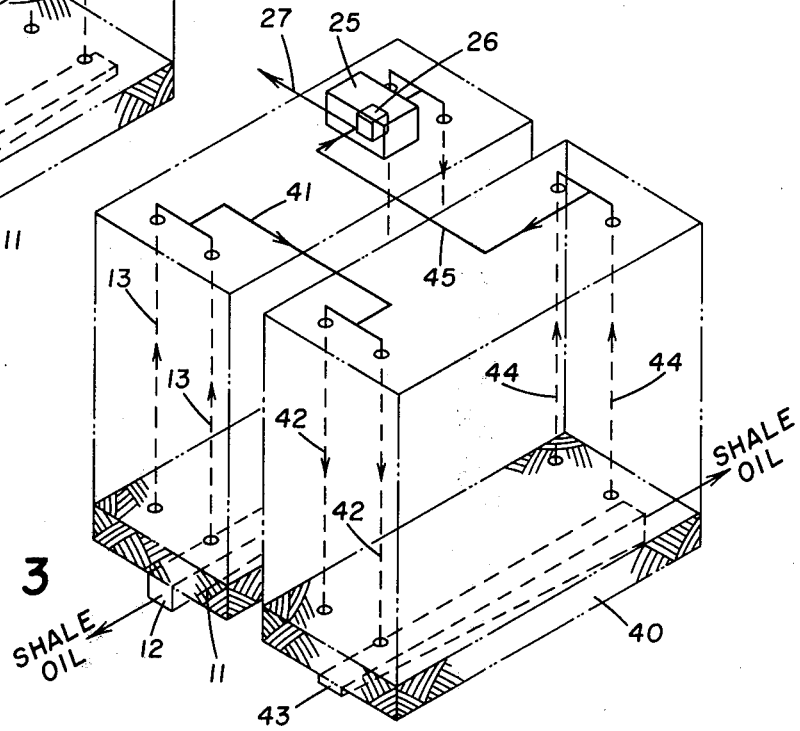
FIG. 3 is a perspective view of a modification of the process shown in FIG. 1.

Since the retorting gas no longer needs to be heated externally, furnaces 16 are no longer required; and since the major pressure drop in the circulation path is due to the furnaces, there is no longer a need for the expensive and power consuming compressors 15. Therefore, when the temperature of the off gas reaches a condition indicating that no further external heat is needed (this normally occurring when approximately two-thirds of zone 11 has been retorted), surface retort unit 14 is replaced with frontal advance unit 25 (see FIG. 3). This frees the expensive, surface retort unit 14 for use in retorting another zone (not shown).

Frontal advance unit 25 is comprised of one or more commercially available low head fans 26 which are capable of circulating the required volume of retorting gas to advance front 11*a* but which require substantially less power to operate than did compressors 15. For example, in a particular retorting operation in accordance with the present invention, a single 48-inch suction, pedestal type 150,000 ACFM (actual cubic foot per minute) centrifugal compressor unit requires approximately a 7000 horsepower electrical motor to provide the differential head necessary to insure proper gas circulation through furnaces 16 and zone 11. A low head fan capable of handling the same volume of gas, i.e., 150,000 ACFM, and generating sufficient circulating pressure with no furnaces present requires only approximately a 2500 horsepower motor.

To summarize the present method as heretofore described, surface retorting unit 14 is used to start the retorting and frontal advance unit 25 is used to complete the method. Compressor means 15 is needed to develop the pressure necessary to force the retorting gas through the high pressure drop heating means 16 where the gas is heated to high temperature before it is injected into retort zone 11. When the temperature of the off gas from zone 11 indicates that adequate heat is available in zone 11 to complete retorting operations, surface retorting unit 14 is replaced with frontal advance unit 25 which circulates the necessary gas with substantially less power requirements. Although the retorting gas is not externally heated when frontal advance unit 25 is in use, the gas picks up sufficient heat from the previously retorted portion of zone 11 as it moves from inlets 20 to outlets 13 to thereby continue the advance of the heat front through retort zone 11.

To aid in replacing surface retorting unit 14 with frontal unit 25, both of said units are portable in that the units are preferably skid mounted (not shown) and the piping has common flanging as at 30, 31, 32 (FIG. 2) so that the units may be exchanged as easily as possible. For most commercial-sized operations, the size and weight of these units will be substantial and since they will likely be transported in rough terrain, tracked vehicles or those having large diameter wheels will likely be required.

When the retorting operation of the present invention reaches the point where surface retorting unit 14 is replaced with frontal advance unit 25, off gas from outlets 13 is routed into a second retort zone 40 by means of piping 41 and inlets 42. The off gas from zone 11 passes through the rubblized shale in zone 40 and gives up heat to preheat zone 40 and aid in eventual retorting of zone 40. Also, this cools the off gas so that it can be more easily handled at the surface. Still further, the heavier hydrocarbons in the hot off gas condense in relatively cool zone 40 and can be recovered later from sump 43.

After the off gas from zone 11 passes through zone 40, it flows to the surface through outlets 44 and via piping 45 is fed into frontal advance unit 25. That portion of the gas that is to be recirculated is fed to the suction of low head fan 26 within unit 25 while any excess gas is split off through line 27 for suitable deposition. Circulation of the off gas is continued through frontal unit 25 until the retorting process in zone 11 has been completed.

What is claimed is:

1. A process of in situ retorting an oil shale deposit to recover hydrocarbons therefrom, said process comprising:

forming a retort zone of rubblized shale within said deposit;

pressurizing a stream of retorting gas by passing it through a compressor means;

heating said pressurized retorting gas stream to a temperature required to retort the oil shale by passing said pressurized gas stream through a heating means;

injecting said heated retorting gas stream into said retort zone to retort said rubblized shale in said retort zone;

recovering gaseous products including said retorting gas from said retort zone;

passing at least a portion of said recovered gaseous products through said compressor means, heating means, and said retort zone until a temperature condition is reached wherein the temperature of the gaseous products being recovered substantially equals a value indicative that there is adequate heat available in said retort zone to complete the retorting process without additional externally supplied heat;

replacing both said compressor means and said heating means with a fan means when said temperature condition is reached;

passing at least a portion of the gaseous products recovered from said retort zone through said fan means; and continuing circulation of said at least a portion of the gaseous products through said retort zone and said fan means until the recovery of hydrocarbons from said retort zone is completed.

2. The in situ retorting process of claim 1 wherein said heating means comprises a furnace means and including:

supplying a second portion of the recovered gaseous products to said furnace means to provide the fuel for said furnace means.

3. A process of in situ retorting an oil shale deposit to recover hydrocarbons therefrom, said process comprising:

forming a first and a second retort zone of rubblized shale within said deposit;

pressurizing a stream of retorting gas by passing it through a compressor means;

heating said pressurized retorting gas stream to a temperature required to retort the oil shale by passing said pressurized gas stream through a heating means;

injecting said heated retorting gas stream into said first retort zone to retort said rubblized shale in said first retort zone;

recovering gaseous products including said retorting gas from said first retort zone;

passing at least a portion of said recovered gaseous products through said compressor means, heating means, and said first retort zone until a temperature condition is reached wherein the temperature of the gaseous products being recovered substantially equals a value indicative that there is adequate heat available in said retort zone to complete the retorting process without additional externally supplied heat;

replacing both said compressor means and said heating means with a fan means when said temperature condition is reached;

passing said gaseous products from said first retort zone through said second retort zone when said temperature condition is reached to cool said gaseous products and to heat rubblized shale in said second retort zone;

recovering gaseous products from said second retort zone;

passing at least a portion of said gaseous products from said retort zone through said fan means to overcome pressure losses; and injecting said gaseous products exiting from said fan means into said first retort zone.

4. The in situ retorting process of claim 3 wherein said heating means comprises a furnace means and including:

supplying a second portion of the recovered gaseous products from said first retort zone to said furnace means to provide the fuel for said furnace means.

5. A process for the in situ retorting of oil shale utilizing surface retorting units which are comprised of gas compressors and furnaces, and frontal advance units which are comprised of low head fans, said process comprising:

passing a gas through said surface retorting units to compress and heat said gas;

injecting said heated gas into a retort zone within an oil shale deposit;

recovering the off gas from said retort zone;

circulating at least a portion of said off gas through said surface retorting units and said retort zone until there is adequate heat available in said zone to complete said retorting operation;

replacing said surface retorting units with said frontal advance units; and circulating at least a portion of the off gas from said retort zone through said frontal advance units and said retort zone until said retorting has been completed.

6. The in situ retorting process of claim 5 including: supplying a portion of said off gas to said furnaces to provide fuel therefor.

7. The in situ retorting process of claim 5 including: passing the off gas from said retort zone through a second retort zone in said oil shale deposit before passing it through said frontal advance units.

* * * * *